US005185805A

United States Patent [19]

Chiang

[11] Patent Number: 5,185,805

[45] Date of Patent: Feb. 9, 1993

[54] TUNED DECONVOLUTION DIGITAL FILTER FOR ELIMINATION OF LOUDSPEAKER OUTPUT BLURRING

[76] Inventor: David Chiang, 649 Caledonia Rd., Dix Hills, N.Y. 11746

[21] Appl. No.: 628,635

[22] Filed: Dec. 17, 1990

[51] Int. Cl.[5] ..... H04R 3/00

[52] U.S. Cl. ..... 381/96; 381/98; 381/59

[58] Field of Search ..... 381/96, 98, 59

[56] References Cited

U.S. PATENT DOCUMENTS 4,888,811 12/1989 Takashi ..... 381/98

*Primary Examiner*—Forester W. Isen
*Assistant Examiner*—Nina Tong

[57] ABSTRACT

A FIR (finite impulse response) type digital filter operates on digital audio signals in modern sound reproduction systems. It is shown that this operation forces the loudspeaker to produce a sound pressure wave having the original signal waveform. Given a multi-driver speaker, its response to a known broad band analog signal (impulsive) is sampled at least as fast as the Nyquist rate. The result is used to construct a deconvolution filter which compacts, in the least-squares sense, the blurred signal (speaker output) back into its original waveform. Since this anti-blurring process is linear and time invariant, it can be applied to the speaker driving signal as a blur preventive. A fine-tuning procedure utilizing Lagrange's Method of Multipliers modifies the deconvolution process such that the blur-free speaker output achieves a degree of flatness in frequency response beyond what could be attained with a simple deconvolution filter.

4 Claims, 1 Drawing Sheet

TUNED DECONVOLUTION DIGITAL FILTER FOR ELIMINATION OF LOUDSPEAKER OUTPUT BLURRING

FIELD OF THE INVENTION

This invention pertains to high fidelity audio systems and more particularly to the waveshaping of audio signals before presentation to the speaker of the system.

BACKGROUND OF THE INVENTION

The loudspeaker as an energy conversion device exhibits its own motion characteristics under excitation. Its various modes of resonance at different frequencies depends on a multitude of mechanical and electrical design parameters. It remains a designer's dream to have flat magnitude-frequency and linear phase-frequency characteristics.

A common technique for modifying the magnitude-frequency characteristic of the input electric signal and thus modifying the magnitude-frequency of the acoustic output is to filter the input in a selective manner. A band of pink noise ⅓ octave wide is fed into the loudspeaker for sound pressure measurement at a fixed distance from the loudspeaker. Signal gain in this particular band can then be changed accordingly. Obviously, this conventional method of "equalizing" is a very coarse adjustment—only the averaged deviation can be corrected. Two undesirable side effects occur—overlap in adjacent band pass filters and phase irregularities at the band edges.

Ishii et al. (U.S. Pat. No. 4,015,089) disclosed a multi-driver speaker system wherein the the relative positions of the drivers along the radiation path helps to create a cancellation of sound waves at a particular frequency. This cancellation results in a favorable condition for a smooth phase characteristic when a particular cross-over network is used. The claim to flat amplitude and linear phase response seems groundless in a strict sense.

Berkovitz et al. (U.S. Pat. No. 4,458,362) uses an adaptive filter to equalize signals for room acoustic compensation. In the same patent it was shown that the same adaptive process can be used for loudspeaker performance improvement. While the adaptive process is desirable for room acoustic compensation, it does not represent what can be achieved ultimately for loudspeaker sound improvement. Though the advantage of the Widrow-Hoff adaptation algorithm is that prior knowledge of the speaker characteristic is not needed, the algorithm generates only approximate values for filter coefficients through stochastic approximation. In terms of loudspeaker sound improvement, an one-time operation, more accurate results can be obtained by the deteministic process of the current disclosure instead of stochastic approximation.

Serikawa et al. (U.S. Pat. No. 4,751,739) corrects the speaker sound pressure frequency characteristic by multi-band digital filters with desired frequency reponses. The coefficients of these filters are generated by inverse Fourier transform of a transfer function resulting from repeated Hilbert transforms and modifications. However, while the Hilbert transforms render the resultant time sequence causal, phase linearity is lost.

BRIEF DESCRIPTION OF THE INVENTION

It is a general object of the invention to provide an improved high fidelity system.

It is another object of the invention to provide a high fidelity system wherein the sound pressure wave produced by the speaker resembles the input electric audio signal in true high fidelity.

It is a further object of the invention to provide a method and apparatus wherein both the amplitude and phase of the input electric signal are shaped to compensate for the inevitable blurring of the signal by the speaker.

Briefly the invention contemplates a method and apparatus for improving the fidelity of an audio reproduction system by deconvolving the electric audio signal with respect to the known blurring effect of the loudspeaker. The deconvolution process is carried out in the form of a FIR type of digital filter. The filter coefficients are derived from the method of least sqares (in the time domain) and then fine-tuned for further enhancement in the frequency response of the speaker output.

BRIEF DESCRIPTION OF THE DRAWING

Other objects, features and advantages of the invention will be apparent from the following detailed description of the invention when read with the accompanying drawing which shows, by way of example and not limitation the presently preferred embodyment of the invention. In the drawing.

DETAILED DESCRIPTION OF THE PREFERRED EMBODIMENT OF THE INVENTION

I. Deconvolution Theory

Figure 1:
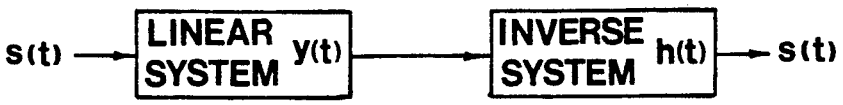
FIG. 1 is a block diagram illustrating the fundamental priciple of the invention.

The term "deconvolution" is widely used in the literature when the input signal to a linear, time-invariant system is recovered from the system output. FIG. 1 shows a deconvolution filter with impulse response h(t) operating on the output of a linear, time-invariant system having the impulse reponse y(t). From the theory of linear systems the overall output is $$s * y * h = \int_{-\infty}^{\infty} \int_{-\infty}^{\infty} s(\theta) y(\tau - \theta) h(t - \tau) d\theta d\tau$$

where s(t) is the arbitrary input.

Deconvolution means the cancellation of the effect of y on s, i.e., if h satisfies $$\int_{-\infty}^{\infty} y(\tau - \theta) h(t - \tau) d\tau = \delta(t - \theta)$$

then $$s*y*h = s*(y*h) = s*\delta = s$$

In general the existence of well-behaved inverse h(t) is questionable because of the difficulty of compacting the dispersed signal into an impulse. However, in the case of loudspeakers, it will be shown that a well-behaved h(t) exists in the form of sampled data. With modern digital technology the process of deconvolution can be readily carried out.

The loudspeaker, as a band-limited device, can be represented by its response y(t) to the input x(t) which is a "band-limited" version of the impulse function δ(t):

$$x(t) = \frac{\sin 2\pi f_h t}{2\pi f_h t}$$

where $f_h$ is the upper limit of the hearing range. This response can be adequately represented by the sample data if the *sampling period T* is smaller than $\frac{1}{2}f_h$ (Nyquist). For practical reasons the response y(t) is truncated at both ends so that only N+1 most significant samples are kept for processing:

$$y_0, y_1, y_2 \cdots y_N$$

II. Apparatus for Measurement of Speaker Impulse Response

Figure 2:
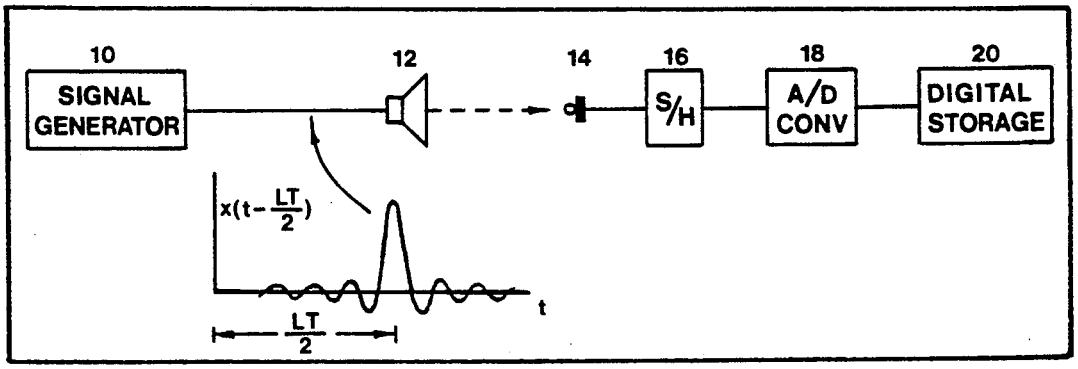
FIG. 2 depicts the measurement of the speaker characteristic which leads to the filter coefficients.

FIG. 2 depicts the generation of y's. At t=0 the function generator 10 starts the signal x(t−LT/2) and ends the signal at t=LT. The excitation period LT is chosen to be sufficiently large such that the signal can be considered, in the engineering sense, as band limited. In response to this excitation, the loudspeaker 12 produces a sound pressure wave y(t−LT/2). Microphone 14 picks up the sound wave at $t=t_a$ where $t_a$ is the travelling time of the sound wave in the air. Starting at $t=t_a$, sample and hold amplifier 16 feeds the signal to the A/D converter 18 every T seconds until data samples fades into an insignificant level. Finally N+1 most significant, consecutive data samples $y_0, y_1, \ldots y_N$ are chosen from the memory 20 to represent the band-limited impulse response.

III. Method of Generaing Filter Coefficients

To obtain the set of filter coefficients designated by $$h_0, h_1, h_2, \ldots h_M$$

The following set of equations in matrix form represents the deconvolution in disrete form. Equivalently, the following matrix equation is the requirement that sound pressure wave follows the electric input signal with a delay of D sampling periods. Parameter D is to be determined later for best speaker performance in both time and frequency domains.

$$[Y]\,[h] \approx [x]$$

where $$[Y] = \begin{bmatrix} y_0 & 0 & 0 & \ldots 0 & \cdot & \cdot & \cdot & \cdots \\ y_1 & y_0 & 0 & \ldots 0 & y_N & y_{N-1} & y_{N-2} & \cdots y_{N-M} \\ y_2 & y_1 & y_0 & \ldots 0 & 0 & y_N & y_{N-1} & \cdots \\ \cdot & \cdot & \cdot & \cdots & 0 & 0 & y_N & \cdots \\ y_M & y_{M-1} & y_{M-2} & \cdots y_0 & \cdot & \cdot & \cdot & \cdots y_{N-1} \\ y_{M+1} & y_M & y_{M-1} & \cdots y_1 & 0 & 0 & 0 & \ldots y_N \end{bmatrix}$$

for convenience N is assumed to be even, and $$[h] = \mathrm{COL}[h_0, h_1, \ldots h_M]$$

$$[x] = \mathrm{COL}[x_0, x_1, \ldots x_{N+M}] \text{ with } x_i = x[(i - N/2 - D)T]$$

This set of equations has no exact solution since the number of unknowns M+1 is smaller than the number of equations (M+1)+(N+1)−1=N+M+1. However, it is common engineering practice to seek least-squares solutions to overdetermined systems. In this case the set of "best" filter coefficients $\{h_i;\ i=0, 1, \ldots M\}$ satisfies $$[Y][h] = [\hat{x}] \tag{1}$$

with $$[\hat{x}] = \mathrm{COL}[\hat{x}_0, \hat{x}_1, \ldots \hat{x}_{N+M}]$$

representing the "nearly exact" replica of the input signal. The error vector e is the difference between the "exact" and the "nearly exact", i.e., $$e_i = x_i - \hat{x}_i,\ i=0,1,\ldots N+M \tag{2}$$

To minimize the sum of squares of these errors $$E = \sum_{i=0}^{N+M} e_i^2 = \{[x]^T - [h]^T [Y]^T\}\{[x] - [Y][h]\} \tag{3}$$

Define the (M+1)×(M+1) sampled autocorrelation matrix as $$[R] = [Y]^T [Y] \tag{4}$$

For minimum error the necessary conditions are $$\frac{\partial E}{\partial h_i} = 0,\ i = 0, 1, \ldots M$$

Solving the resultant linear set of equations yields $$[h] = [R]^{-1} [Y]^T [x] \tag{5}$$

This is the *untuned deconvolution filter*. Since the matrix [R] is positive definite and of the "Toeplitz" form, it can be inverted very efficiently by the Levinson-Cholesky algorithm. For any output lag D the time domain speaker behavior (filtered) can be seen by computing E according to Eq.(3). Meantime the speaker frequency response is obtained by plotting $$|X(f)| = \left| \sum_{n=0}^{N+M} x_n e^{-i2\pi nfT} \right| vs\ f.$$

The selection of optimum lag $D_{opt}$, yielding the best performance, is as follows:

The delay for the best "least-squares" error in time domain may or may not coincide with the delay for maximum flatness in frequency domain. However, in most cases these two delay values are close to each other.

Selection of optimal delay should be biased in favor of best magnitude-frequency response at slight increase in time domain error. This is due to the fact that human ears are more sensitive to frequency content than phase linearity.

IV. Method of Filter Tuning

The choice of the filter order M+1 is governed by the desire to have M as small as possible so as to minimize computation in the implementation, while having M as large as possible so as to faithfully deconvolve away the speaker characteristic. In general, a small M flattens broad magnitude irregularities. As M increases, finer peaks and dips can be corrected. The mathematical manipulation discussed below "fine tunes" the filter coefficients so as to eliminate any local irregularity without increasing the filter length M.

Consider the case in which a deconvolution filter leaves P+1 magnitude-frequency irregularities at and near frequencies $f_0, f_1, \ldots f_P$. To mitigate the sonic effect of these anomalies the following set of quadratic constraints, based on the frequency response of the sequence $x_i$, are imposed onto the original minimization problem:

$$g_p(\hat{x}) = \left| \sum_{n=0}^{N+M} \hat{x}_n e^{-i2n\pi f_p T} \right|^2 - K = 0, p = 0, 1, \ldots P$$

where constant K is the desired speaker output magnitude for all frequencies.

Following Lagrange's Method of Multipliers, the error to minimize becomes $$E' = E + \sum_{p=0}^{P} \lambda_p g_p(x) \tag{3'}$$

where E is the sum defined in Eq. (3) and $\lambda_p$'s are Lagrangian multipliers. Note that every term in Eq.(3') is a quadratic form of $\hat{x}$. Given a set of $\lambda_p$'s, this particular structure allows for an *explicit expression for the filter coefficients*

$$h'_0, h'_1, \ldots h'_M$$

with all the constraints (which depend on $\lambda_p$'s) automatically in effect. To show this, the partial derivatives are set to zero again $$\frac{\partial E'}{\partial h_i'} = 0, i = 0, 1, \ldots M$$

which translates to the new set of linear equations to solve:

$$[Y]^T \left\{ [I] + \sum_{p=0}^{P} \lambda_p ([C_p][C_p]^T + [S_p][S_p]^T) \right\} [Y][h] = [Y]^T[x]$$

where $$[C_p] = \mathrm{COL}[1, \cos 2\pi f_p T, \cos 4\pi f_p T, \ldots \cos 2(N+M)\pi f_p T]$$

$$[S_p] = \mathrm{COL}[0, \sin 2\pi f_p T, \sin 4\pi f_p T, \ldots \sin 2(N+M)\pi f_p T]$$

The (M+N+1)×(M+N+1) matrix inside the brackets { }could be simplified to $$[U] = [u_{ij}], i,j = 0, 1, \ldots N+M$$

where $$u_{ij} = \delta_{ij} + \sum_{p=0}^{P} \lambda_p \cos 2\pi(i-j) f_p T, \ \delta_{ij} = 1 \text{ if } i = j = 0 \text{ otherwise.}$$

In a manner similar to Eq.(4), the modified autocorrelation matrix is defined as:

$$[R'] = [Y]^T[U][Y] \tag{4'}$$

Thus, the *tuned deconvolution filter is*

$$[h'] = [R']^{-1}[Y]^T[x] \tag{5'}$$

It can readily be shown that [R'] is also positive definite and Toeplitz.

The design procedure for the tuned deconvolution filter for any loudspeaker is summarized as follows:

a. Sample speaker response to the band-limited impulse and digitize to obtain $y_i$, i=0, 1, . . . N
b. Compute [R] by Eq.(4).
c. Compute untuned filter coefficients by Eq.(5) for different output time lags and compare performances for optimal delay.
d. Use frequency response data to set the Lagrangian multipliers for fine tuning.
e. Compute new filter coefficients by Eq.s (4') and (5').

Steps d and e can be repeated if the trial set of Lagrangian multipliers does not yield the satisfactory result.

V. Preferred Embodiment of the Invention

Figure 3:
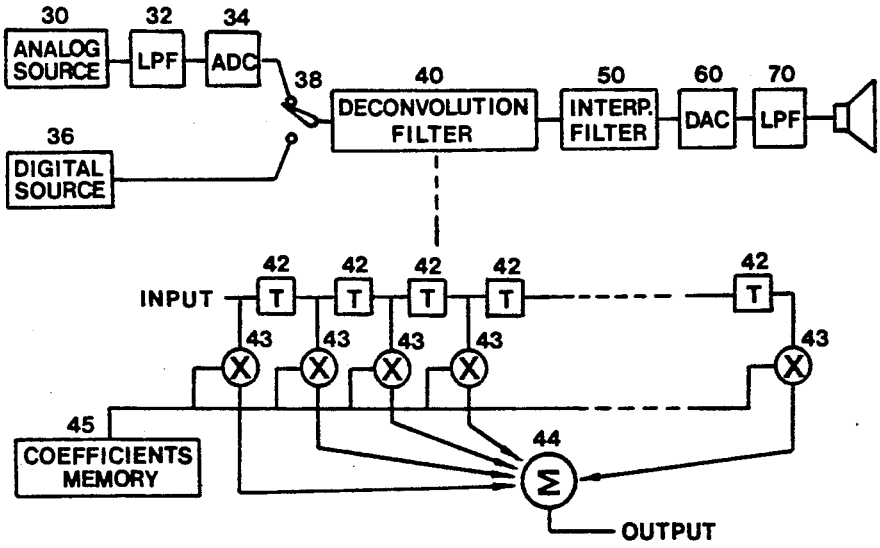
FIG. 3 is the preferred embodiment of the invention.

FIG. 3 is the diagram of one half of a stereo hi-fi system incorporating the invention. Analog input signal 30 (tuner, phonograph, analog tape etc.) of suitable level, say 1 volt rms, is first anti-aliased by low pass filter 32 and then digitized by the A/D converter 34. The output of the A/D converter or the direct digital input 36 (compact disc, digital audio tape, etc.) can be switch selected 38. The deconvolution filter 40 has in its ROM storage 41 a set of coefficients generated as described in section IV and based on the measurement as described in section II on the speaker 80. Delay elements 42 can be implemented by shift registers, charge coupled devices, FIFO memories or ordinary RAM's with sequential access. Multipliers 43 and accumulator 44 are already commercially available. (e.g., device AM29510 made by Advanced Micro Devices, Inc., Sunnyvale, Calif.) It is also possible to construct the entire filter by programming a microprocessor. More importantly, since FIR type digital filter has been successfully fabricated in a single IC, (for example, the device YM3434 made by Yamaha Corp. of Japan constitutes the interpolating filter 50 depicted in FIG. 3) a special purpose LSI device can be designed to handle the entire deconvolution with internal or external coefficient memory 45. It is also noted that both digital filters 40 and 50 can be combined into one filter. If memory capacity permits, multiple sets of deconvolution filter coefficients for different loudspeakers can be stored and eventually switch-selected by the user.

It is intended that all matter contained in the above description shall be illustrative and not limiting. For example, it should be apparent to those skilled in the art that a different deconvolution filter can be constructed by a different error criterion than Eq.(3) such as $$E = \sum_{i=0}^{N+M} |e_i|$$

What is claimed is:

1. Method of making a finite impulse response filter for deconvolving audio signals to be converted by a given speaker to sound pressure waves comprising the steps of: providing a digital multiplier-accumulator having digital multiplicand inputs for receiving digitized audio signals, M+1 digital multiplier imputs for receiving filter coefficients ($h_i$; i=0,1, . . . M) and digital outputs for transmitting digitized deconvolved audio signals; generating the digital band-limited impulse response $y_i$, i=0,1, . . . N, by driving the said speaker with the signal $\sin 2\pi f_h t/2\pi f_h t$, wherein the frequency $f_h$ is the upper limit of the hearing range, measuring the acoustic output by a microphone and converting to digital data with sampling rate $1/T \geqq 2f_h$; calculating, from the values $y_i$, i=0,1, . . . N, the set of coefficients $h_i$, i=0,1, . . . M; and applying said set of coefficients $h_i$ to said digital multiplier inputs.

2. The method of claim 1 wherein said calculating step includes solving the matrix equation $$[h]=[R]^{-1}[Y]^T[x]$$

where

[h]=COL [$h_0$, $h_1$, . . . $h_M$] is the filter coefficients

[x]=COL [$x_0$, $x_1$, . . . $x_{N+M}$] is the delayed idealized FIR

[Y] is the N+M+1 by M+1 matrix formed with the measured speaker impulse (band-limited) response $y_i$, i=0, 1, . . . N $[R]=[Y]^T[Y]$ is the sampled autocorrelation matrix 3. The method of claim 1 further comprising the step of comparing filter performances for different values of delay associated with said vector [x] and selection of an optimum lag $D_{opt}$ which yields the maximally flat response in the frequency domain.

4. The method of claim 3 further comprising the step of fine tuning the coefficients, and therefore further flattening the speaker frequency response, by solving the matrix equation $$[h']=[R']^{-1}[Y]^T[x]$$

where

[h']=COL [$h'_0$, $h'_1$, . . . $h'_M$] is the improved coefficients

[R']=[Y]$^T$[U][Y] is the tuned sampled autocorrelation matrix

[U] is the (N+M+1, N+M+1) tuning matrix constructed for the purpose of tuning out the remaining irregularities caused by finite filter length.

* * * * *